US009136660B2

(12) United States Patent
Kato

(10) Patent No.: US 9,136,660 B2
(45) Date of Patent: Sep. 15, 2015

(54) FEMALE TERMINAL

(71) Applicant: YAZAKI CORPORATION, Minato-ku, Tokyo (JP)

(72) Inventor: Hajime Kato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/204,086

(22) Filed: Mar. 11, 2014

(65) Prior Publication Data

US 2014/0194016 A1 Jul. 10, 2014

Related U.S. Application Data

(63) Continuation of application No. PCT/JP2012/006150, filed on Sep. 26, 2012.

(30) Foreign Application Priority Data

Sep. 27, 2011 (JP) ..... 2011-210869

(51) Int. Cl.
*H01R 31/00* (2006.01)
*H01R 13/11* (2006.01)
*H01R 4/18* (2006.01)

(52) U.S. Cl.
CPC ..... *H01R 31/00* (2013.01); *H01R 4/184* (2013.01); *H01R 13/113* (2013.01)

(58) Field of Classification Search
CPC ..... H01R 13/113; H01R 13/111
See application file for complete search history.

(56) References Cited

U.S. PATENT DOCUMENTS

| | | | | |
|---|---|---|---|---|
| 6,152,788 | A | 11/2000 | Hata et al. | |
| 7,014,515 | B2 * | 3/2006 | Lutsch et al. | 439/843 |
| 2001/0019925 | A1 * | 9/2001 | Heimueller | 439/851 |
| 2006/0121797 | A1 * | 6/2006 | Casses et al. | 439/851 |
| 2006/0172618 | A1 * | 8/2006 | Yamashita et al. | 439/852 |
| 2010/0197178 | A1 * | 8/2010 | Hotea et al. | 439/852 |
| 2011/0045712 | A1 | 2/2011 | Mukuno | |
| 2012/0108113 | A1 | 5/2012 | Yamaguchi et al. | |

FOREIGN PATENT DOCUMENTS

| | | | |
|---|---|---|---|
| EP | 2451016 | A1 | 5/2012 |
| GB | 2225183 | A | 5/1990 |
| JP | 2002-100430 | A | 4/2002 |

(Continued)

OTHER PUBLICATIONS

A European office action letter issued on Feb. 24, 2015 in the counterpart European patent application.

(Continued)

*Primary Examiner* — Gary Paumen
(74) *Attorney, Agent, or Firm* — Marvin A. Motsenbocker; Mots Law, PLLC

(57) ABSTRACT

A female terminal includes a terminal connection portion for a male terminal to be inserted and an electric wire connection portion connecting with an electric wire to be electrically connected to the male terminal. The terminal connection portion includes a male terminal entrance for the male terminal to be inserted and a male terminal exit for a tip of the male terminal passing through the male terminal entrance to be inserted. At least one of the male terminal entrance or the male terminal exit includes a support portion configured to contact with the male terminal to support the male terminal.

3 Claims, 3 Drawing Sheets

(56) References Cited

FOREIGN PATENT DOCUMENTS

| | | | |
|---|---|---|---|
| JP | 2011-040249 | A | 2/2011 |
| JP | 2011-044256A | A | 3/2011 |
| WO | 2011/001821 | A1 | 1/2011 |

OTHER PUBLICATIONS

A Japanese office action letter issued on May 19, 2015 in the counterpart Japanese patent application.

* cited by examiner

FEMALE TERMINAL

CROSS REFERENCE TO RELATED APPLICATION

This application is a Continuation of PCT Application No. PCT/JP2012/006150, filed on Sep. 26, 2012, and claims the priority of Japanese Patent Application No. 2011-210869, filed on Sep. 27, 2011, the content of both of which is incorporated herein by reference.

BACKGROUND

1. Technical Field

The present invention relates to a female terminal electrically connected to a male terminal.

2. Related Art

Japanese Patent Application Laid-Open No. 2002-100430 and Japanese Patent Application Laid-Open No. 2011-44256 propose technologies concerning a female terminal electrically connected to a male terminal.

This type of female terminal includes a boxlike terminal connection portion and an electric wire connection portion. The male terminal is inserted into the terminal connection portion. The electric wire connection portion is crimped to an electric wire that is electrically connected to the male terminal. The terminal connection portion contains an elastic contact member (elastic contact piece) contactable with the male terminal.

SUMMARY

According to the above-mentioned female terminals, however, a male terminal inserted into terminal connection portion moves in the terminal connection portion due to an external vibration (e.g., vehicle vibration). This degrades reliability of connection between a male terminal and the elastic contact member.

The present invention aims at providing a female terminal capable of suppressing the reduction of reliability of connection between a male terminal and an elastic contact member.

An aspect of the present invention is a female terminal including: a terminal connection portion for a male terminal to be inserted; and an electric wire connection portion connecting with an electric wire to be electrically connected to the male terminal, wherein the terminal connection portion includes a male terminal entrance for the male terminal to be inserted, and a male terminal exit for a tip of the male terminal passing through the male terminal entrance to be inserted, and wherein at least one of the male terminal entrance or the male terminal exit includes a support portion configured to contact with the male terminal to support the male terminal.

According to the aspect, at least one of the male terminal entrance and the male terminal exit is provided with a support portion that supports a male terminal. This can prevent the male terminal inserted into the terminal connection portion from moving in the terminal connection portion due to an external vibration (e.g., vehicle vibration). That is, the male terminal can be held in an ideal posture. This enables to suppress the reduction of reliability of connection between the male terminal and the elastic contact member.

The terminal connection portion may have a surface extending in an insertion direction of the male terminal, and the support portion may be formed integrally with the surface.

According to the configuration, the support portion is formed integrally with a surface of the terminal connection portion. Suppose a case where the support portion is formed independently of the terminal connection portion. Unlike this case, a procedure to fix the support portion to the terminal connection portion can be eliminated and reduce manufacturing cost.

The support portion may be formed on each of two opposite surfaces of the terminal connection portion.

According to the configuration, the support portion is formed on each of two opposite surfaces of the terminal connection portion. The support portion supports the male terminal from two opposite surfaces of the terminal connection portion. This can more reliably prevent the male terminal from moving in the terminal connection portion due to an external vibration.

The embodiments of the invention can provide a female terminal capable of suppressing the reduction of reliability of connection between a male terminal and an elastic contact member.

DETAILED DESCRIPTION

Figure 1:
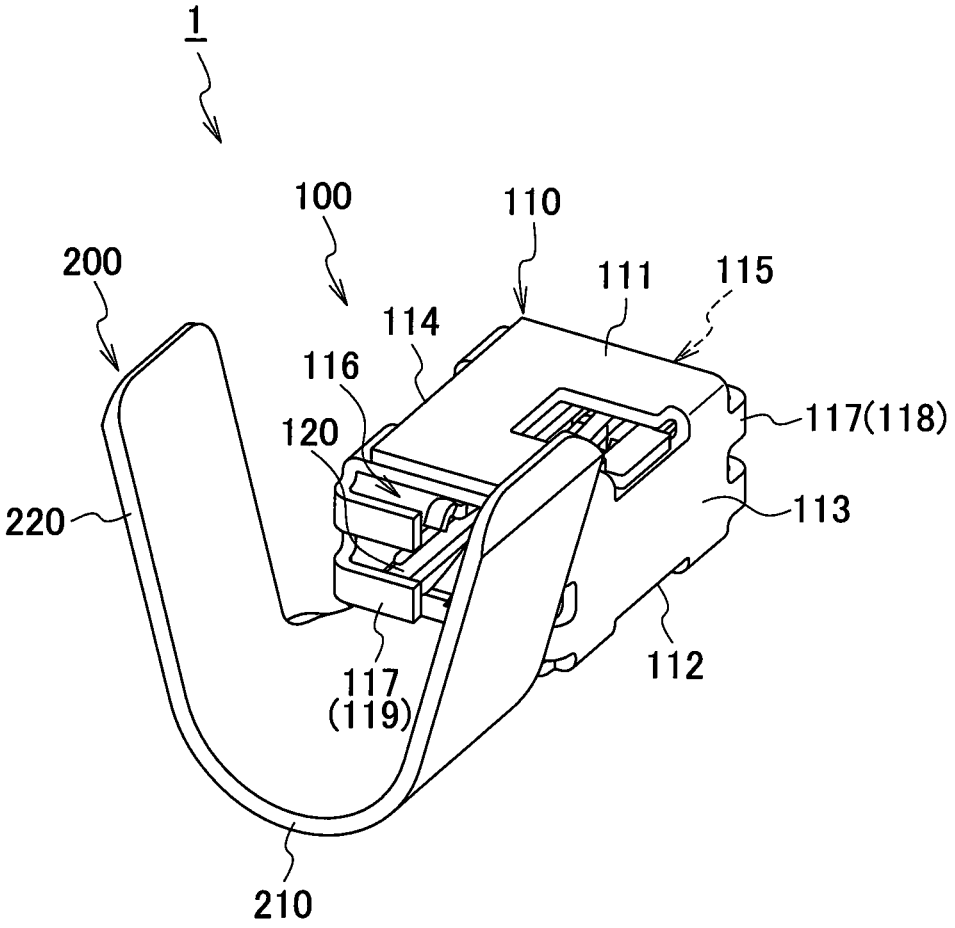
FIG. 1 is a perspective view illustrating a female terminal according to an embodiment of the invention.

The following describes the female terminal according to embodiments of the invention with reference to the accompanying drawings. Specifically, (1) configuration of female terminal 1, (2) configuration of positioning protrusion 117, (3) operation and effect, and (4) other embodiments will be described.

Throughout the drawing, the same or similar elements when shown in more than one figure are designated by the same or similar reference numerals. It should be noted that the drawing is schematic and dimensional ratios may differ from actual values.

Therefore, the following description needs to be taken into consideration in estimating specific dimensions. Dimensional relations and ratios may differ between figures.

(1) Configuration of Female Terminal 1

Figure 2A:
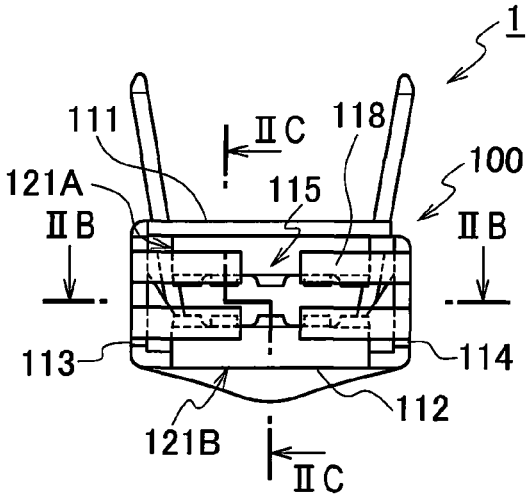
FIG. 2A is a front view illustrating the female terminal according to the embodiment.
Figure 2B:
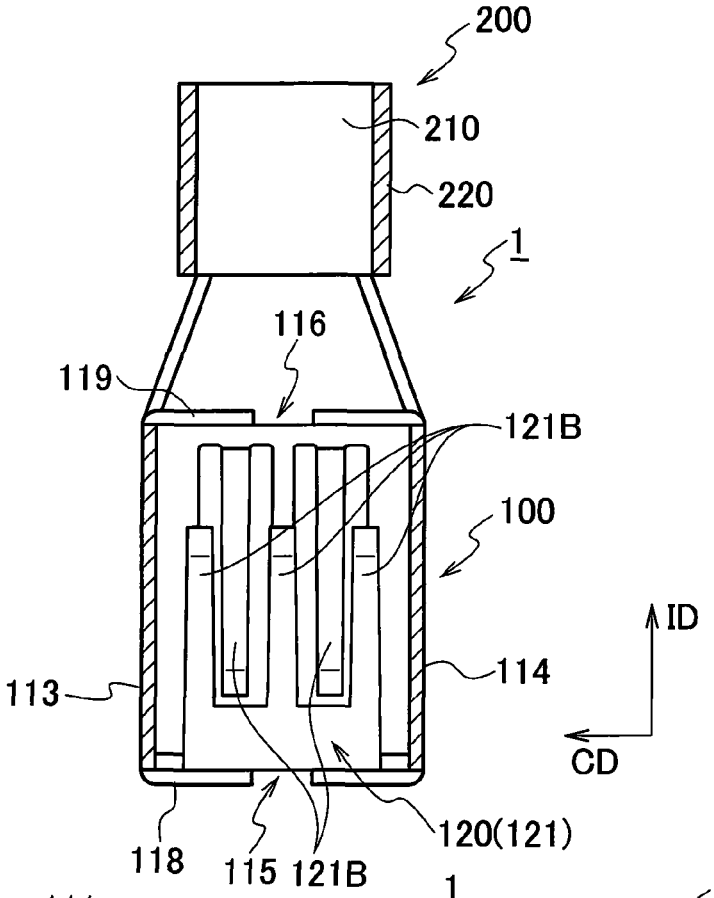
FIG. 2B is a cross sectional view taken along the line IIB-IIB of FIG. 2A.
Figure 2C:
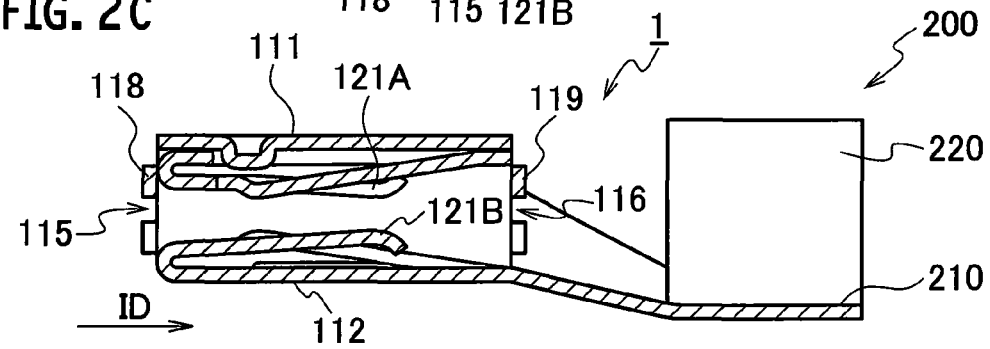
FIG. 2C is a cross sectional view taken along the line IIC-IIC of FIG. 2A.

The configuration of a female terminal 1 according to the embodiment will be described with reference to the accompanying drawings. FIG. 1 is a perspective view illustrating a female terminal 1 according to the embodiment. FIG. 2A is a front view illustrating the female terminal 1 according to the embodiment. FIG. 2B is a cross sectional view taken along the line IIB-IIB of FIG. 2A. FIG. 2C is a cross sectional view taken along the line IIC-IIC of FIG. 2A. The female terminal 1 according to the embodiment holds a high-voltage electrical power line used for a vehicular electric system. The female terminal 1 is electrically connected to a male terminal (not shown).

As illustrated in FIGS. 1 and 2A-2C, the female terminal 1 includes a terminal connection portion 100 and an electric wire connection portion 200. A male terminal is inserted into the terminal connection portion 100. The electric wire connection portion 200 connects with an electric wire (not shown) electrically connected to the male terminal.

The terminal connection portion 100 includes a body portion 110 and an elastic contact member 120. The elastic contact member 120 is built into the body portion 110 and is contactable with a male terminal.

The body portion 110 is shaped into a rectangular box surrounded by a top surface 111, a bottom surface 112, and side surfaces 113 and 114 along insertion direction ID for a male terminal to be inserted. The body portion 110 is provided with a male terminal entrance 115 and a male terminal exit 116. A male terminal is inserted into the male terminal entrance 115. The male terminal exit 116 is provided at a position opposite the male terminal entrance 115. After the male terminal passes through the male terminal entrance 115, the tip of the male terminal is inserted into the male terminal exit 116.

The male terminal entrance 115 and the male terminal exit 116 are provided with a positioning protrusion 117 (support portion). The positioning protrusion 117 will be described in detail later. An elastically deformable elastic contact member 120 is provided for each of the top surface 111 and the bottom surface 112 of the terminal connection portion 100 (see FIGS. 2A-2C).

As illustrated in FIGS. 2A-2C, the elastic contact member 120 includes one or more elastic contact pieces 121 cantilevered at one of insertion direction ID for a male terminal. If the male terminal is inserted into the body portion 110, the elastic contact piece 121 is elastically deformed to contact with the male terminal due to a restoring force. The male terminal is sandwiched between an elastic contact piece 121A provided for the top surface 111 and an elastic contact piece 121B provided for the bottom surface 112. The elastic contact member 120 thereby contacts with the male terminal. The elastic contact member 120 according to the embodiment is formed integrally with the body portion 110 and the electric wire connection portion 200.

The electric wire connection portion 200 is crimped to fasten an electric wire (not shown) that is electrically connected to the male terminal. The electric wire connection portion 200 may fasten an electric wire by welding.

The electric wire connection portion 200 includes a bottom portion 210 and a crimping portion 220. The bottom portion 210 positions a core (not shown) of the electric wire. The crimping portion 220 is continuous with the bottom portion 210. The crimping portion 220 is bent and raised from the bottom portion 210 to crimp the electric wire core and coating material. The crimping portion 220 is bent and crimped to fold the electric wire positioned at the bottom portion 210. The electric wire can be thereby fastened to the bottom portion 210.

(2) Configuration of Positioning Protrusion 117

Figure 3A:
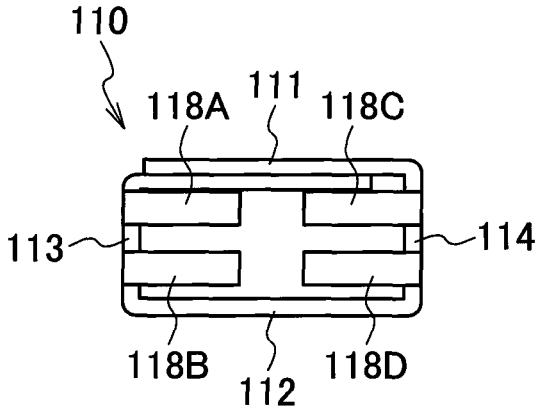
FIG. 3A is a front view illustrating the female terminal according to the embodiment viewed from a male terminal.
Figure 3B:
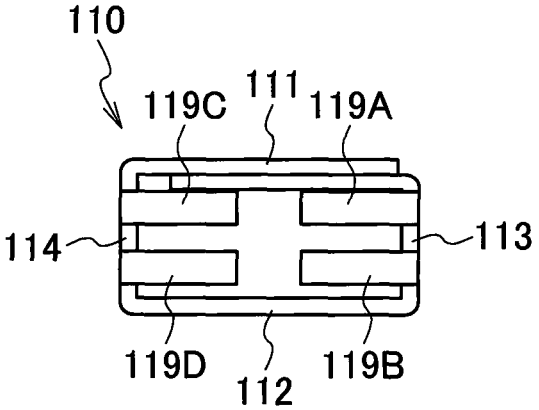
FIG. 3B is a front view illustrating the female terminal according to the embodiment viewed from an electric wire connection portion.

The configuration of the positioning protrusion 117 will be described with reference to the accompanying drawings. FIG. 3A is a front view illustrating the female terminal 1 according to the embodiment viewed from a male terminal. FIG. 3B is a front view illustrating the female terminal 1 according to the embodiment viewed from an electric wire connection portion 200. FIGS. 3A and 3B illustrate only the body portion 110 and omits the elastic contact member 120.

As illustrated in FIGS. 2A-2C and 3A-3B, the positioning protrusion 117 is formed at the male terminal entrance 115 and the male terminal exit 116. The positioning protrusion 117 includes an entrance-side support portion 118 and an exit-side support portion 119. The entrance-side support portion 118 is formed at the male terminal entrance 115. The exit-side support portion 119 is formed at the male terminal exit 116.

The entrance-side support portion 118 supports a male terminal while contacting with it. The entrance-side support portion 118 is formed at each of the two opposite side surfaces 113 and 114 of the body portion 110. The entrance-side support portion 118 includes two surfaces 118A and 118B, and two surfaces 118C and 118D. The surfaces 118A and 118B are formed integrally with the side surface 113. The surfaces 118C and 118D are formed integrally with the side surface 114. The surfaces 118A to 118D extend from the side surfaces 113 and 114 and bend to be orthogonal to these side surfaces. The male terminal is inserted into a gap between the surfaces 118A to 118D. Edges of the surfaces 118A to 118D support the male terminal.

The exit-side support portion 119 contacts with the tip of the male terminal passing through the male terminal entrance 115 and thereby supports the male terminal. The exit-side support portion 119 is formed at each of the two opposite side surfaces 113 and 114 of the body portion 110. The exit-side support portion 119 includes two surfaces 119A and 119B, and two surfaces 119C and 119D. The surfaces 119A and 119B are formed integrally with the side surface 113. The surfaces 119C and 119D are formed integrally with the side surface 114. The surfaces 119A to 119D extend from the side surfaces 113 and 114 and bend to be orthogonal to these side surfaces. The tip of the male terminal passes through the male terminal entrance 115 and is inserted into a gap between the surfaces 119A to 119D. Edges of the surfaces 119A to 119D support the tip of the male terminal.

(3) Operation and Effect

The embodiment provides at least one of the male terminal entrance 115 and the male terminal exit 116 with the positioning protrusion 117 for supporting the male terminal. This can prevent the male terminal inserted into the terminal connection portion 100 from moving in the terminal connection portion 100 due to an external vibration (e.g., vehicle vibration). That is, the male terminal can be held in an ideal posture. The embodiment can suppress the reduction of reliability of connection between the male terminal and the elastic contact member 120, that is, between the male terminal and the female terminal 1.

The embodiment forms the positioning protrusion 117 integrally with a surface of the terminal connection portion 100 or the side surface 113 or 114 of the body portion 110 according to the embodiment. Suppose a case where the positioning protrusion 117 is formed independently of the terminal connection portion 100. Unlike this case, the embodiment eliminates the need for a procedure to fix the positioning protrusion 117 to the body portion 110. The embodiment can also reduce manufacturing cost.

The embodiment forms the positioning protrusion 117 on each of two opposite surfaces of the terminal connection portion 100 or the side surfaces 113 and 114 of the terminal connection portion 100 according to the embodiment. That is, the positioning protrusion 117 supports the male terminal from the two opposite side surfaces 113 and 114 of the terminal connection portion 100. This can more reliably prevent the male terminal from moving in the terminal connection portion 100 due to an external vibration.

(4) Other Embodiments

While there has been disclosed the specific embodiment of the present invention, it is to be distinctly understood that the present invention is not limited to the description and drawings included in the disclosure. According to the disclosure, those skilled in the art will appreciate various alternative embodiments, examples, and operational technologies.

For example, the embodiment of the invention may be modified as follows. While it has been described that the positioning protrusion 117 includes the entrance-side support portion 118 and the exit-side support portion 119, the invention is not limited thereto. The positioning protrusion 117 may include only one of the entrance-side support portion 118 and the exit-side support portion 119. The positioning protrusion 117 may be formed on at least one of the male terminal entrance 115 and the male terminal exit 116.

While it has been described that the entrance-side support portion 118 and the exit-side support portion 119 are formed on each of the two opposite side surfaces 113 and 114 of the body portion 110, the invention is not limited thereto. The entrance-side support portion 118 and the exit-side support portion 119 may be formed on each of the two opposite surfaces, namely, the top surface 111 and the bottom surface 112 of the body portion 110.

The entrance-side support portion 118 and the exit-side support portion 119 are not necessarily formed on the two opposite surfaces of the body portion 110. The entrance-side support portion 118 and the exit-side support portion 119 may be formed on at least one of the surfaces.

While it has been described that the entrance-side support portion 118 and the exit-side support portion 119 are formed integrally with the body portion 110, the invention is not limited thereto. The entrance-side support portion 118 and the exit-side support portion 119 may be formed independently of the terminal connection portion 100.

While it has been described that the elastic contact member 120 is formed integrally with the body portion 110 and the electric wire connection portion 200, the invention is not limited thereto. The elastic contact member 120 may be formed independently of the body portion 110 or the electric wire connection portion 200.

Although the present invention has been described above by reference to the embodiments, the present invention is not limited to those and the configuration of parts can be replaced with any configuration having a similar function.

What is claimed is:

1. A female terminal comprising:

a terminal connection portion for a male terminal to be inserted; and an electric wire connection portion for connection with an electric wire to be electrically connected to the male terminal, wherein the terminal connection portion comprises a body portion having a top surface, a bottom surface, and two opposite side surfaces which extend in an insertion direction of the male terminal, and an elastic contact member including a top elastic contact piece provided on the top surface and a bottom elastic contact piece provided on the bottom surface which sandwich and contact with the male terminal inserted in the terminal connection portion, wherein the body portion comprises:

a male terminal entrance for the male terminal to be inserted, and a male terminal exit for a tip of the male terminal passing through the male terminal entrance to be inserted, and wherein at least one of the male terminal entrance or the male terminal exit comprises a support portion which is formed integrally with at least one of the two opposite side surfaces and contacts with and supports the male terminal inserted in the terminal connection portion, and wherein the support portion supports the male terminal inserted in the terminal connection portion, from the at least one of the two opposite side surfaces.

2. The female terminal according to claim 1, wherein the support portion is formed on each of the two opposite side surfaces of the terminal connection portion.

3. The female terminal according to claim 1, wherein the support portion is formed at a proximal end of the female terminal so as to make initial contact with the male terminal as compared to other portions of the female terminal, when the male terminal is inserted into the female terminal.

* * * * *